US010967494B2

(12) United States Patent
Smith

(10) Patent No.: US 10,967,494 B2
(45) Date of Patent: Apr. 6, 2021

(54) HAMMER WITH LINEARLY ADJUSTABLE CLAW

(71) Applicant: Scott L. Smith, Jacksonville, FL (US)

(72) Inventor: Scott L. Smith, Jacksonville, FL (US)

( * ) Notice: Subject to any disclaimer, the term of this patent is extended or adjusted under 35 U.S.C. 154(b) by 0 days.

(21) Appl. No.: 15/201,329

(22) Filed: Jul. 1, 2016

(65) Prior Publication Data

US 2018/0001459 A1 Jan. 4, 2018

(51) Int. Cl.
*B25D 1/04* (2006.01)

(52) U.S. Cl.
CPC ..... *B25D 1/045* (2013.01); *B25D 2250/015* (2013.01); *B25D 2250/141* (2013.01); *B25D 2250/371* (2013.01); *B25D 2250/381* (2013.01)

(58) Field of Classification Search
CPC ... B25D 1/02; B25D 1/00; B25D 1/04; B25D 1/05
See application file for complete search history.

(56) References Cited

U.S. PATENT DOCUMENTS 1,410,407 A * 3/1922 Luttrell ..... B25D 1/045 254/26 R
2,340,140 A * 1/1944 O'Nell ..... B25D 1/04 254/26 R
4,314,593 A * 2/1982 Schwartz ..... B25D 1/00 81/22
4,422,620 A * 12/1983 Nitzberg ..... B25D 1/045 254/26 E
5,022,137 A * 6/1991 Sorensen ..... B25B 5/067 29/468
6,568,667 B1 * 5/2003 Hall ..... B25B 5/068 269/170
6,961,973 B1 * 11/2005 Smith ..... B25B 13/14 7/100
8,177,192 B1 * 5/2012 Taylor ..... B25G 1/08 254/26 E
2003/0141644 A1 * 7/2003 Thomas ..... B25B 5/068 269/6
2005/0184439 A1 * 8/2005 Janson ..... B25B 5/006 269/6
2006/0226588 A1 * 10/2006 Khachatoorian ..... B25B 5/068 269/6
2010/0019214 A1 * 1/2010 Cole ..... B25D 1/045 254/26 R
2014/0175352 A1 * 6/2014 Smith ..... B25D 1/04 254/26 R

* cited by examiner

*Primary Examiner* — Tyrone V Hall, Jr.
(74) *Attorney, Agent, or Firm* — Goldstein Law Offices, P.C.

(57) ABSTRACT

A hammer has a claw assembly that is linearly moveable relative to the head of the hammer so as to improve leverage and range of prying for nail removal. A locking mechanism secures the claw assembly in a position. The locking mechanism may be automatic or manual, and may comprise a ratcheting mechanism with a pawl and rack, or a clamping mechanism with a deflectable sleeve and engaged bar, or a biased pin lock mechanism.

5 Claims, 21 Drawing Sheets

HAMMER WITH LINEARLY ADJUSTABLE CLAW

FIELD OF THE INVENTION

This invention relates to claw hammers, and, more particularly to a claw hammer with a claw that is moveable relative to the head of the hammer so as to improve leverage and range of prying for nail removal.

BACKGROUND

As is well known, a conventional claw hammer is a tool primarily used for pounding nails into or extracting nails from some other object. Generally, a claw hammer is associated with woodworking but is not limited to use with wood products.

A conventional claw hammer 10 is illustrated in FIG. 1. From a profile, it roughly resembles the letter "T". The handle 15 is the long vertical part. The head assembly 20 includes a striking head 25 and a curved two-prong claw 30 opposite the striking head. The claw 30 curves downward (i.e., towards the handle) and splits in the middle forming a "V" shape gap 35. The claw increases in thickness from the free end to the intersection with the handle 15. This gap 35 is the part of the claw 30 of the hammer 10 that is commonly used for extracting nails from wood. The curved claw 30 in conjunction with the handle 15 is used to gain leverage when extracting a nail.

The curvature and length of the claw 30 varies among hammers. By way of example, the claw of a framing hammer may feature less curvature than the claw curvature of a finishing hammer and therefore does not have as much leverage for removing nails. While claws are useful for fully extracting short nails in one fluid motion, long nails pose challenges. A claw may not have sufficient length and range of motion to fully extract the nail. The claw may be adequate to partially remove the nail. A user must then struggle to extract the remaining embedded portion of the nail, such as by applying another tool, e.g., pliers, and considerable pulling force or by applying a board, such as a 2×4, to raise the height of the fulcrum point. Although a hammer could be provided with an extremely long curved claw sufficient to extract even the longest nail, such a hammer would be extremely cumbersome to wield.

The invention is directed to overcoming one or more of the problems and solving one or more of the needs as set forth above.

SUMMARY OF THE INVENTION

To solve one or more of the problems set forth above, in an exemplary implementation of the invention, a hammer includes a linearly adjustable ratcheting claw. The claw assembly includes a claw with a v-shaped groove for engaging a nail. The claw assembly is movable linearly relative to the striking head of the hammer. A channel is configured to receive and glide along an engaging portion of the handle. A locking mechanism secures the claw assembly in a raised or lowered position. In one embodiment, the locking mechanism is a ratcheting mechanism with a pawl that controllably engages and disengages a rack of spaced apart teeth. The pawl and rack regulate linear movement of the claw assembly. A spring compartment in the handle contains a compression spring that urges the claw assembly towards its topmost (extended) position. A nail head lever is attached to the concave side of the claw. The lever extends outwardly from the handle to a point past the vertex of the v-groove. During extraction of a nail using the claw, the head of the nail may bear against the lever. The lever may be attached with a pivot pin and biased to pivot towards an abutting nail head. The lever may also be operably coupled to a linkage coupled to a pawl. The linkage may advance the pawl to allow retraction of the claw assembly when the lever is pushed by a nail. While the pawl locks the claw assembly in place, a permanent magnet at the apex of the handle helps to secure the claw assembly.

In another embodiment, the locking mechanism is a clamp, such as a spring clamp. The spring clamp includes a sleeve biased to a skewed configuration in relation to a bar. The biasing causes the sleeve to frictionally engage the bar. The bar may be textured or a toothed rack to enhance locking engagement. A control arm coupled to the sleeve allows deflection and alignment of the sleeve to permit sliding motion of the sleeve relative to the bar. The sleeve is pivotally contained within the claw assembly and moves with the claw assembly. The bar is external to the claw assembly and remains stationary.

In another embodiment, the locking mechanism is a locking pin. The pin is biased towards a bar with a plurality of spaced apart holes, each defining a locking position. A free end of the pin extends through one of a plurality of the holes in the bar, when aligned with a hole. A biasing mechanism allows deflection of the pin away from the bar and out of the hole to permit free sliding motion of the claw assembly. The pin and biasing mechanism are parts of and move with the claw assembly. The bar with holes is external to the claw assembly and remains stationary.

Regardless of the particular locking mechanism used, a hammer according to principles of the invention includes a claw assembly that can be moved in linear sliding fashion from a fully raised position in general alignment with the hammer head to a fully lowered position between the hammer head and handle. The locking mechanism may be manual or automatic. The locking mechanism secures the claw assembly in a desired position relative to the hammer head.

An exemplary hammer with a linearly moveable claw assembly according to principles of the invention has a handle, a neck, a hammer head and a claw assembly. The neck of the hammer has a first end and an opposite second end. The neck may be integrally formed with and extending from either or both of the head and handle. The handle is attached to the first end and the hammer head is attached to the second end. The claw assembly includes a claw body from which a curved two-prong claw extends. The claw body contains a guide and a locking mechanism. The guide slidingly engages the neck. The locking mechanism controllably secures (i.e., locks) the claw assembly at a position along the neck. The claw assembly is linearly moveable between the first end and second end of the neck.

A variety of locking mechanism embodiments are effective. In one embodiment, the locking mechanism is a ratcheting mechanism. The hammer includes a toothed rack attached to the neck, and the ratcheting mechanism includes a pawl pivotally coupled (i.e. coupled in a manner that allows pivoting motion, such as coupling by a pivot pin or hinge) to the claw body and positioned to controllably engage (i.e., in a manner that can be controlled by a user or use) the toothed rack. A lever may be coupled to the pawl. The lever may be pivotally attached to the claw body and pivotally moveable from a released position to an engaged position. In the released position, the pawl may be moveable relative to the rack, and in the engaged position, the pawl may be fixed and engaged by the rack. The lever may be in proximity to the curved two-prong claw, in which case the lever may react to a nail head and be movable to the released position by reaction with the nail head extending through the curved two-prong claw. A spring may bias (i.e., urge) the lever into an engaged position. Such a spring may be contained in the claw body.

In another embodiment, the locking mechanism is a bar clamp. The hammer may include a bar parallel to the neck and in a fixed position relative to the neck and the locking mechanism may be a bar clamp within the claw body. The bar clamp may be moveable from a released position to an engaged position. In the released position, the bar clamp disengages the bar. In the engaged position the bar clamp frictionally engages the bar and resists movement of the bar clamp relative to the bar. A biasing mechanism may urge the bar clamp into an engaged position. The biasing mechanism may be a spring, such as a leaf spring. The biasing mechanism and bar clamp may be integrally formed. The bar clamp may have an end extending from the claw body. That end may be manipulable by a user (i.e., capable of being maneuvered by a user) to move the bar clamp from an engaged position to a released position. The bar may be textured to enhance frictional engagement. The bar may include a rack with a plurality of spaced apart teeth. The bar clamp may include a bushing (or sleeve) with an aperture sized to receive a portion of the bar. In the engaged position the bushing is skewed angled relative to the bar to frictionally engage the bar, and in the released position the bushing is aligned to the bar to allow movement of the bushing relative to the bar.

In yet another embodiment, the locking mechanism is a pin lock. The hammer includes a bar parallel to the neck and in a fixed position relative to the neck. The bar has a plurality of spaced apart apertures. The locking mechanism includes a pin with a free end extending from the claw body towards the bar. The pin is moveable from a released position to an engaged position. In the released position the pin disengages the bar. In the engaged position the free end of the pin extends through one of the plurality of spaced apart apertures. A biasing mechanism may urge the pin into an engaged position. The biasing mechanism may be a spring, such as a leaf spring.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Figure 1:
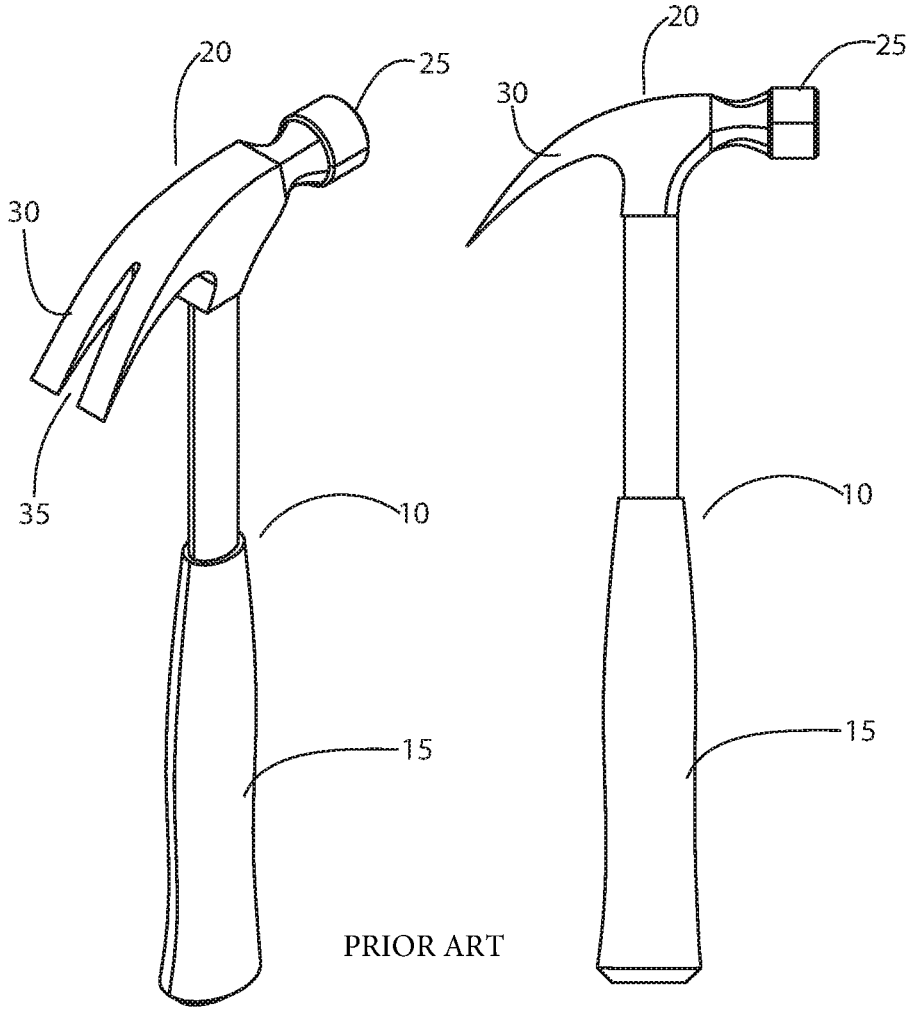
FIG. 1 provides profile and perspective views that conceptually illustrate a prior art conventional claw hammer.
Figure 2:
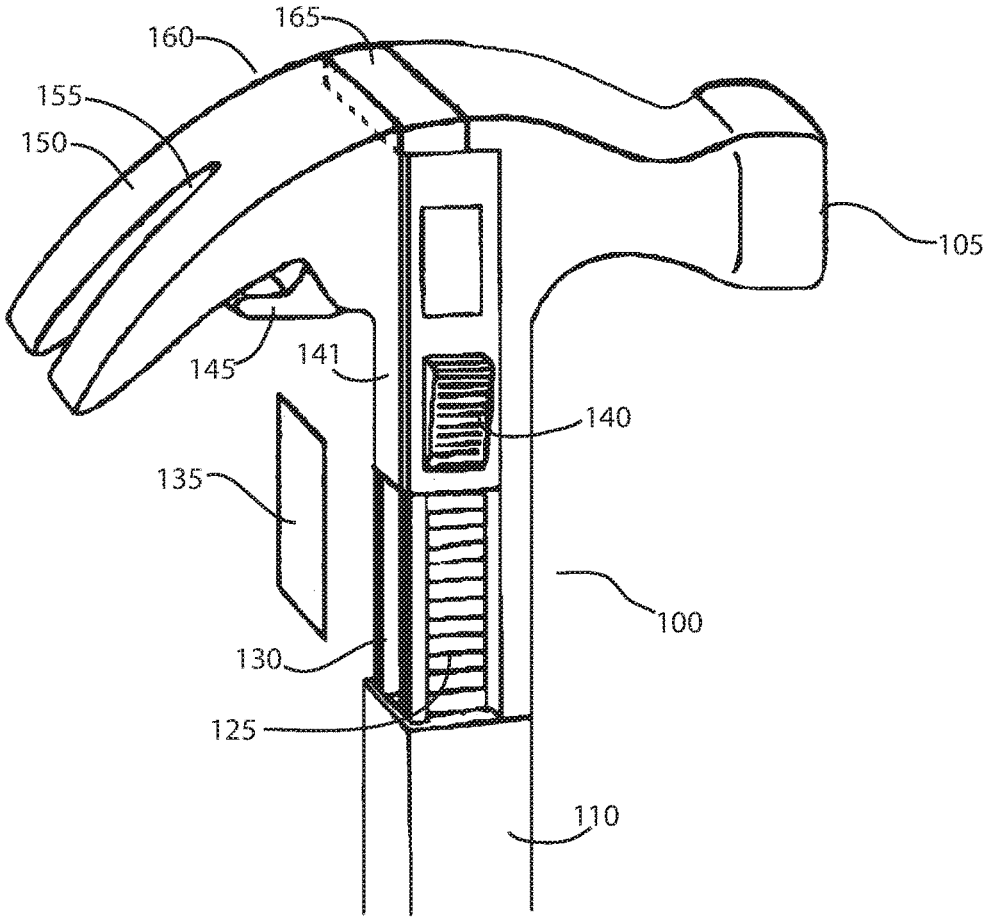
FIG. 2 provides a perspective view of an exemplary embodiment of a hammer with a linearly adjustable ratcheting claw according to principles of the invention.

Referring now to FIG. 2, a perspective view of an exemplary embodiment of a hammer 100 with a linearly adjustable ratcheting claw assembly 160 according to principles of the invention is shown. The claw assembly 160 includes a claw 150 with a v-shaped groove 155 for engaging a nail. The claw assembly 160 is movable linearly relative to the striking head 105 of the hammer. A channel 141 is configured to receive and glide along an engaging portion of the handle. A ratcheting mechanism, which includes a manual switch 140, causes a pawl to engage and disengage a rack 125 of spaced apart teeth. The pawl and rack regulate linear movement of the claw assembly 160.

A spring compartment 130 in the handle 110 contains a compression spring 131 that urges the claw assembly towards its topmost position, as shown in FIG. 2. The spring may be a coil, leaf or other type of biasing means that resists compression. A removable cover 135 closes the opening of the spring compartment 130. The cover 135 fits flush against the opening so as to avoid interference with up and down motion of the claw assembly 160.

A nail head lever 145 is attached to the concave side of the claw 150. The lever 145 extends outwardly from the handle to a point past the vertex of the v-groove. During extraction of a nail using the claw 150, the head of the nail may bear against the lever 145. The lever 145 may be attached with a pivot pin and biased to pivot towards an abutting nail head. The lever 145 may also be operably coupled to a linkage coupled to a pawl. The linkage may advance the pawl to allow retraction of the claw assembly 160 when the lever 145 is pivoted by an advancing nail.

A permanent magnet 165 is attached at the apex of the handle 110. The magnet 165 is stationary. The claw assembly 160 is comprised of a material to which the magnet 165 is magnetically attracted (e.g., a ferrous material). When the claw assembly 160 is in the fully raised (i.e., topmost) position as shown in FIG. 2, the magnet 165 helps securely hold the claw assembly 160. Rattling, jostling and unintended movement of the claw assembly 160 are alleviated by the magnet 165.

Figure 3:
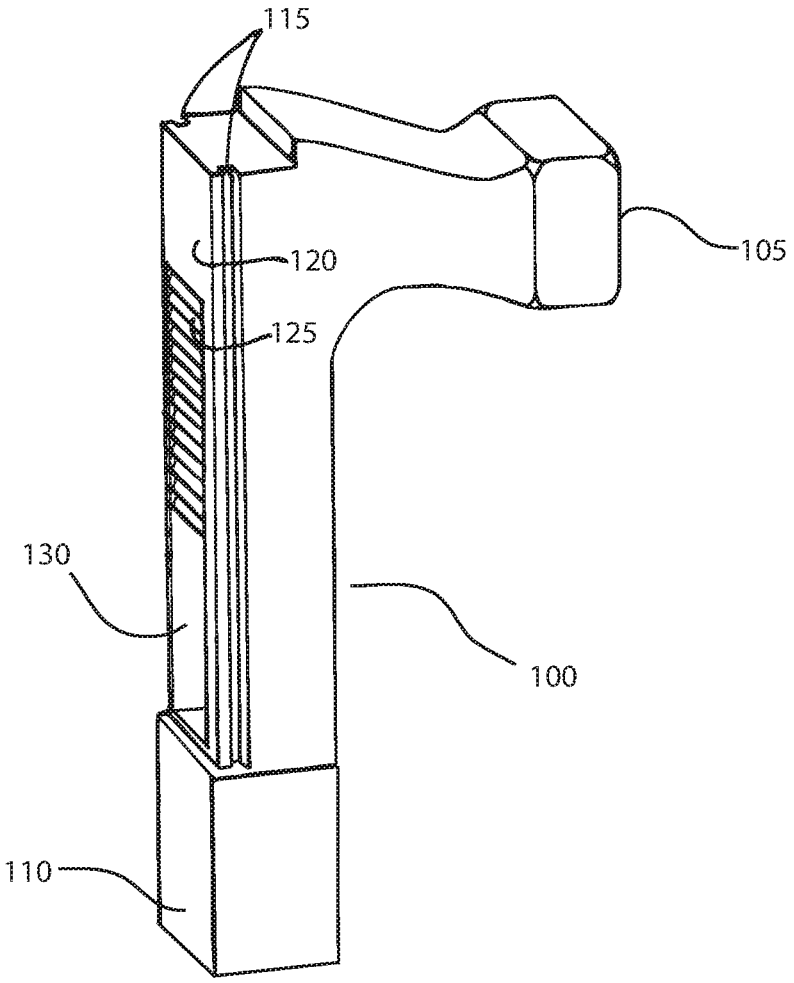
FIG. 3 provides a perspective view of an exemplary embodiment of a portion of a hammer, with the linearly adjustable ratcheting claw removed, according to principles of the invention.

FIG. 3 provides a perspective view of an exemplary embodiment of a handle and striking portion of a hammer 100, with the linearly adjustable ratcheting claw removed, according to principles of the invention. The claw assembly abuts side 120 and is movable linearly relative to the striking head 105 of the hammer. Channels 115 are provided to receive flanged ends (i.e., rails) of a channel of the claw assembly, which glides along an engaging portion of the handle. A rack 125 of spaced apart teeth for the ratcheting action. Notice that the rack is positioned differently than in the embodiment of FIG. 2. The particular location of the rack is not important so long as it enables ratcheting control of linear movement of the claw assembly.

A spring compartment 130 in the handle 110 contains a compression spring 131 that urges the claw assembly towards its topmost position, as discussed above in relation to FIG. 2. The spring may be a coil, leaf or other type of biasing means that resists compression.

Figure 4:
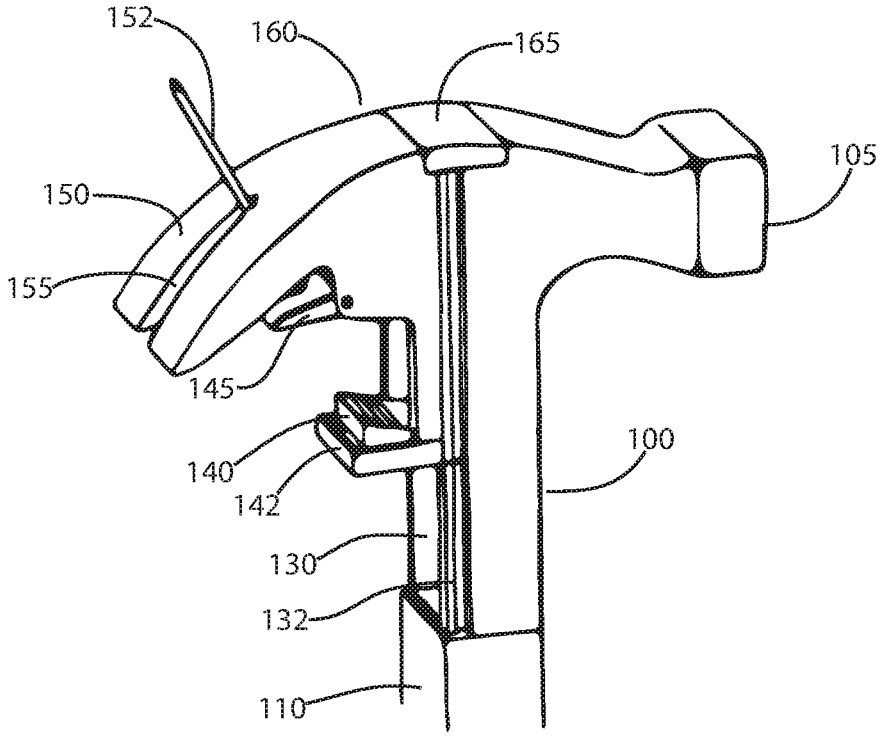
FIG. 4 provides a perspective view of another exemplary embodiment of a hammer with a linearly adjustable ratcheting claw according to principles of the invention.

Referring now to FIG. 4, a perspective view of another exemplary embodiment of a hammer 100 with a linearly adjustable ratcheting claw assembly 160 according to principles of the invention is shown. As with the embodiment described above, the claw assembly 160 includes a claw 150 with a v-shaped groove 155 for engaging a nail. The claw assembly 160 is movable linearly relative to the striking head 105 of the hammer. A channel of the claw assembly with flanged ends is configured to receive and glide along an engaging portion of the handle. The flanged ends slide within channels 132 in the handle 110. A ratcheting mechanism, which includes a manual switch 140 and a cantilevered support 142, causes a pawl to engage and disengage a rack of spaced apart teeth. The pawl and rack regulate linear movement of the claw assembly 160.

A spring compartment 130 in the handle 110 contains a compression spring 131 that urges the claw assembly towards its topmost position, as shown in FIG. 4. The spring may be a coil, leaf or other type of biasing means that resists compression.

A nail head lever 145 is attached to the concave side of the claw 150. The lever 145 extends outwardly from the handle to a point past the vertex of the v-groove. During extraction of a nail using the claw 150, the head of the nail 152 may bear against the lever 145. The lever 145 may be attached with a pivot pin and biased to pivot towards the abutting nail head. The lever 145 may also be operably coupled to a linkage coupled to a pawl. The linkage may advance the pawl to allow retraction of the claw assembly 160 when the lever 145 is pivoted by an advancing nail.

A permanent magnet 165 is attached at the apex of the handle 110. The magnet 165 is stationary. The claw assembly 160 is comprised of a material to which the magnet 165 is magnetically attracted (e.g., a ferrous material). When the claw assembly 160 is in the fully raised (i.e., topmost) position as shown in FIG. 4, the magnet 165 helps securely hold the claw assembly 160. Rattling, jostling and unintended movement of the claw assembly 160 are alleviated by the magnet 165.

Figure 5:
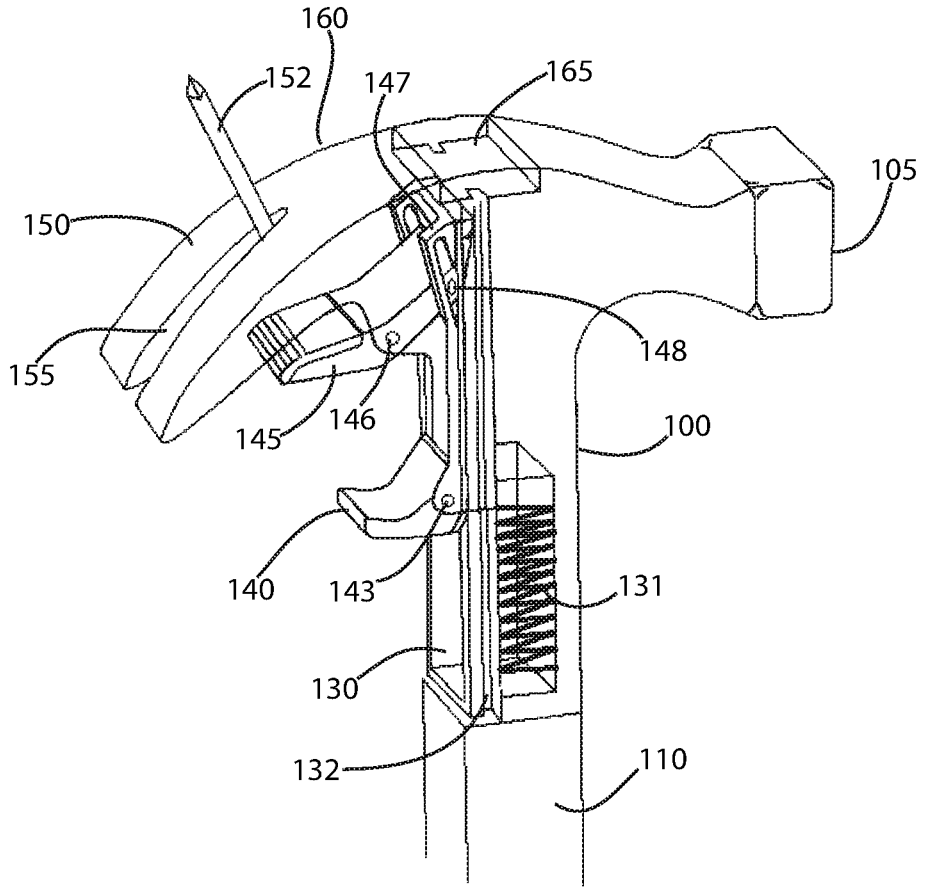
FIG. 5 provides a perspective view of another exemplary embodiment of a hammer with a linearly adjustable ratcheting claw according to principles of the invention.

FIG. 5 provides a perspective view of another exemplary embodiment of a hammer 100 with a linearly adjustable ratcheting claw assembly 160 according to principles of the invention. Certain portions of the hammer are shown transparent, to conceptually illustrate components that would otherwise be hidden by the solid structures. The claw assembly 160 includes a claw 150 with a v-shaped groove 155 for engaging a nail 152. The claw assembly 160 is movable linearly relative to the striking head 105 of the hammer. A flanged channel is configured to engage and glide in channels 132 along an engaging portion of the handle. A ratcheting mechanism which includes a manual switch 140 (e.g., lever or slide) that causes a pawl to engage and disengage a rack of spaced apart teeth. The pawl and rack regulate linear movement of the claw assembly 160.

A spring compartment 130 in the handle 110 contains a compression spring 131 that urges the claw assembly towards its topmost position, as shown in FIG. 2. The spring may be a coil, leaf or other type of biasing means that resists compression. A removable cover 135 closes the opening of the spring compartment 130. The cover 135 fits flush against the opening so as to avoid interference with up and down motion of the claw assembly 160.

A nail head lever 145 is attached to the concave side of the claw 150. The lever 145 extends outwardly from the handle to a point past the vertex of the v-groove. During extraction of a nail using the claw 150, the head of the nail may bear against the lever 145. The lever 145 may be attached with a pivot pin 146 and biased to pivot towards an abutting nail head. The lever 145 may also be operably coupled to a guide rail 147 by guide pins 148. Pivoting movement of the lever 145 may engage and release the pawl to allow locking and retraction of the claw assembly 160.

A permanent magnet 165 is attached at the apex of the handle 110. The magnet 165 is stationary. The claw assembly 160 is comprised of a material to which the magnet 165 is magnetically attracted (e.g., a ferrous material). When the claw assembly 160 is in the fully raised (i.e., topmost) position as shown in FIG. 2, the magnet 165 helps securely hold the claw assembly 160. Rattling, jostling and unintended movement of the claw assembly 160 are alleviated by the magnet 165.

Figure 6:
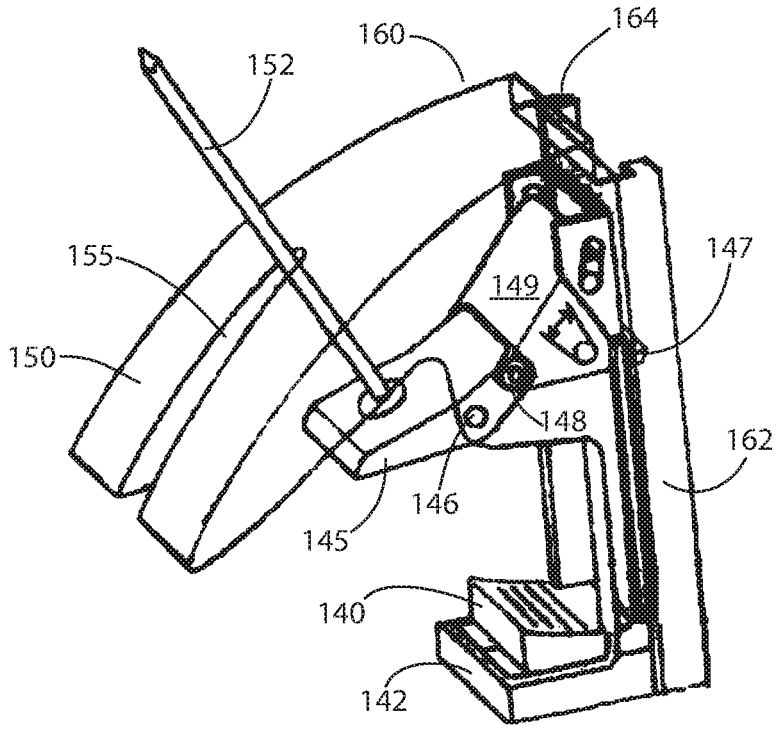
FIG. 6 provides a perspective view of an exemplary embodiment of a claw assembly for a hammer with a linearly adjustable ratcheting claw according to principles of the invention.

FIG. 6 provides a perspective view of an exemplary embodiment of a claw assembly 160 for a hammer with a linearly adjustable ratcheting claw according to principles of the invention. The claw assembly 160 includes a claw 150 with a v-shaped groove 155 for engaging a nail 152. The claw assembly 160 is movable linearly relative to the striking head 105 of the hammer. Flanged channels 162, 164 are configured to engage and glide in channels along an engaging portion of a handle. A ratcheting mechanism which includes a manual switch 140 that causes a pawl 147 to engage and disengage a rack of spaced apart teeth. The pawl 147 and rack regulate linear movement of the claw assembly 160.

A nail head lever 145 is attached to the concave side of the claw 150. The lever 145 extends outwardly from the handle to a point past the vertex of the v-groove. During extraction of a nail using the claw 150, the head of the nail may bear against the lever 145. The lever 145 may be attached with a pivot pin 146 and biased to pivot towards an abutting nail head. The lever 145 may also be operably pivotally coupled to a second lever 149 configured to pivot in a direction opposite to the pivoting direction of the primary lever 145. The secondary lever 149 may be spring biased, such as with a torsion spring. Pivoting movement of the primary lever 145 may engage and release the pawl to allow locking and retraction of the claw assembly 160.

Figure 7:
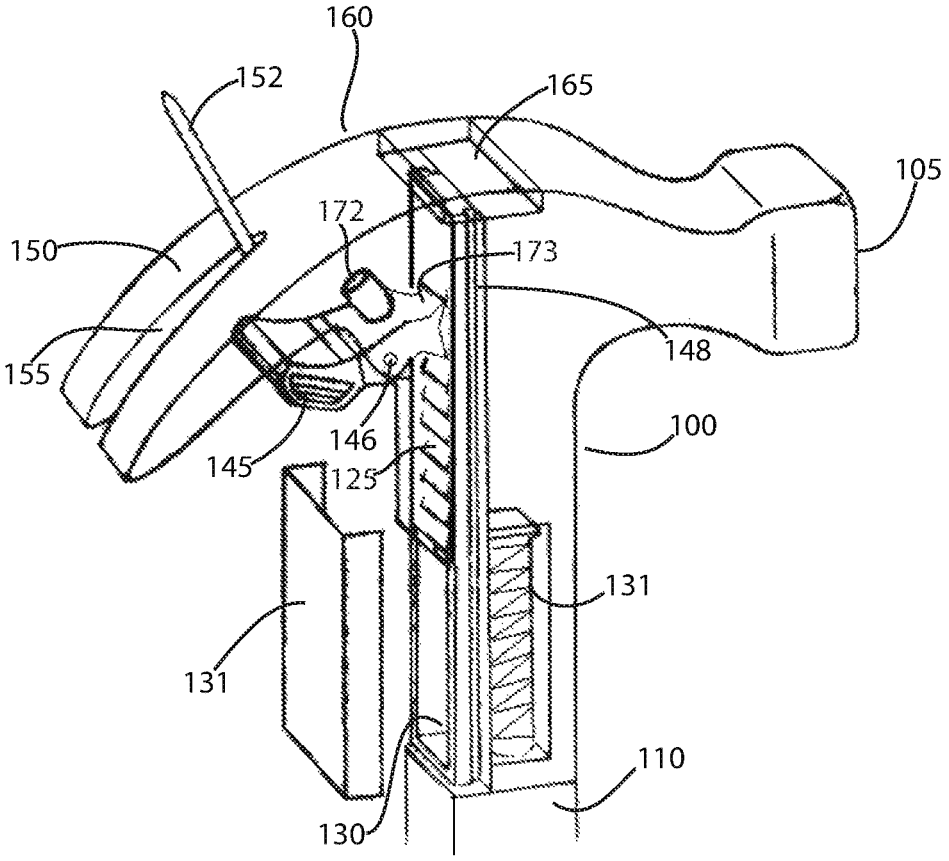
FIG. 7 provides a perspective view of another exemplary embodiment of a hammer with a linearly adjustable ratcheting claw according to principles of the invention.

FIG. 7 provides a perspective view of another exemplary embodiment of a hammer with a linearly adjustable ratcheting claw according to principles of the invention. The claw assembly 160 includes a claw 150 with a v-shaped groove 155 for engaging a nail 152. The claw assembly 160 is movable linearly relative to the striking head 105 of the hammer. A flanged channel is configured to engage and glide in channels 148 along an engaging portion of the handle. A ratcheting mechanism causes a pawl 173 to engage and disengage a rack 125 of spaced apart teeth. The pawl 173 and rack 125 regulate linear movement of the claw assembly 160.

A spring compartment 130 in the handle 110 contains a compression spring 131 that urges the claw assembly towards its topmost position, as shown in FIG. 7. The spring 131 may be a coil, leaf or other type of biasing means that resists compression. A removable cover 131 closes the opening of the spring compartment 130. The cover 131 fits flush against the opening so as to avoid interference with up and down motion of the claw assembly 160.

A nail head lever 145 is attached to the concave side of the claw 150. The lever 145 extends outwardly from the handle to a point past the vertex of the v-groove. During extraction of a nail using the claw 150, the head of the nail may bear against the lever 145. The lever 145 may be attached with a pivot pin 146 and magnetically biased to pivot to a locking position. A magnet 172 is provided to urge the lever and pawl into a locking position. Pivoting movement of the lever 145 may engage and release the pawl 173 to allow locking and retraction of the claw assembly 160.

Figure 8:
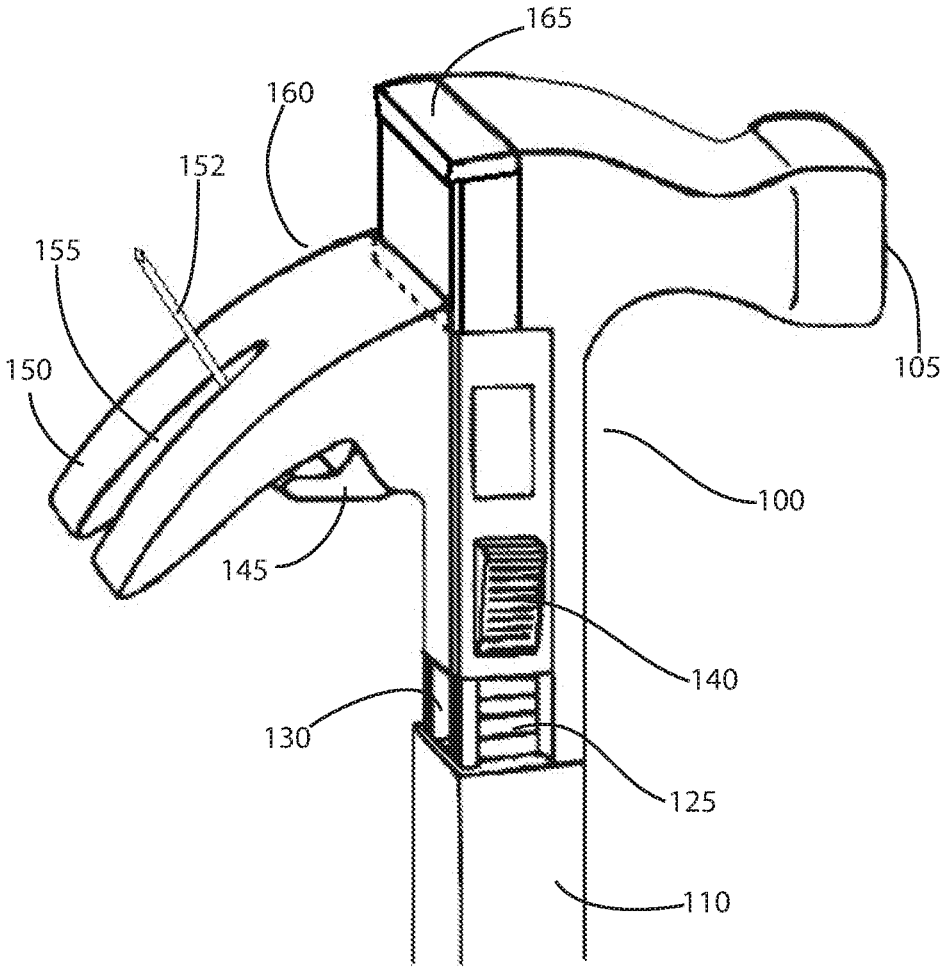
FIG. 8 provides a perspective view of another exemplary embodiment of a hammer with a linearly adjustable ratcheting claw in a retracted position according to principles of the invention.

FIG. 8 provides a perspective view of another exemplary embodiment of a hammer 100 with a linearly adjustable ratcheting claw assembly 160 in a retracted position according to principles of the invention. The hammer 100 is substantially the same as the embodiment in FIG. 2. The claw assembly 160 is shown moved linearly relative to the striking head 105 of the hammer to an extracting position. The distance between the fulcrum at the magnet 165 and the engaged nail 152 has been substantially increased. This distance provides increased leverage and range of motion to extract a nail 152. After the nail is extracted, the pawl may be released (i.e., disengaged from the rack) and the claw assembly may be returned to its fully extended position as shown in FIG. 2.

Figure 9:
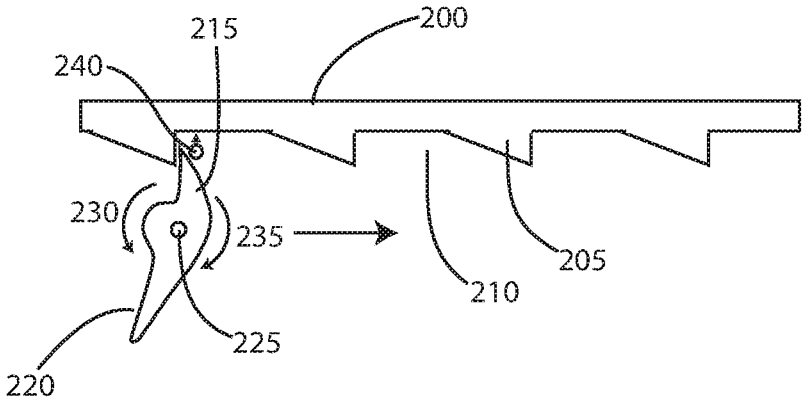
FIG. 9 schematically illustrates an exemplary embodiment of a ratcheting rack and pawl assembly for a hammer with a linearly adjustable ratcheting claw according to principles of the invention.

FIG. 9 schematically illustrates an exemplary embodiment of a ratcheting rack 200 and pawl 215 assembly for a hammer with a linearly adjustable ratcheting claw according to principles of the invention. The ratchet allows continuous linear motion in only one direction (i.e., the retracting direction) while preventing motion in the opposite direction (the extended direction), until a pawl 215 is released. The ratchet includes a linear rack 200 with teeth 205, and a pivoting, springloaded finger called a pawl 215 that engages the teeth. The teeth 205 are uniform but asymmetrical, with each tooth having a moderate slope on one edge and a much steeper slope on the other edge. When the pawl is moving in the unrestricted (i.e., retracting) direction, the pawl 215 easily slides up and over the gently sloped edges of the teeth, with a spring forcing it (possibly with an audible "click") into the depression 210 between the teeth as it passes the tip of each tooth. When the pawl 215 moves in the opposite (backward) direction, however, the pawl will catch against the steeply sloped edge of the first tooth it encounters, thereby locking it against the tooth and preventing any further motion in that direction. The pawl's range of rotation is controllably restricted to ensure catching until released, while allowing pivoting for retracting linear movement. By way of example and not limitation a stop 240 may prevent rotation of the pawl in one direction 235, until the stop is moved, while permitting substantial rotation in the opposite direction 230. In one embodiment, the pawl 215 is coupled to a lever 220 acted upon, directly or indirectly, by the head of a nail. The head of a nail pushing against the lever 220 causes the pawl 215 to move in the retracting direction along the rack 200.

Figure 10:
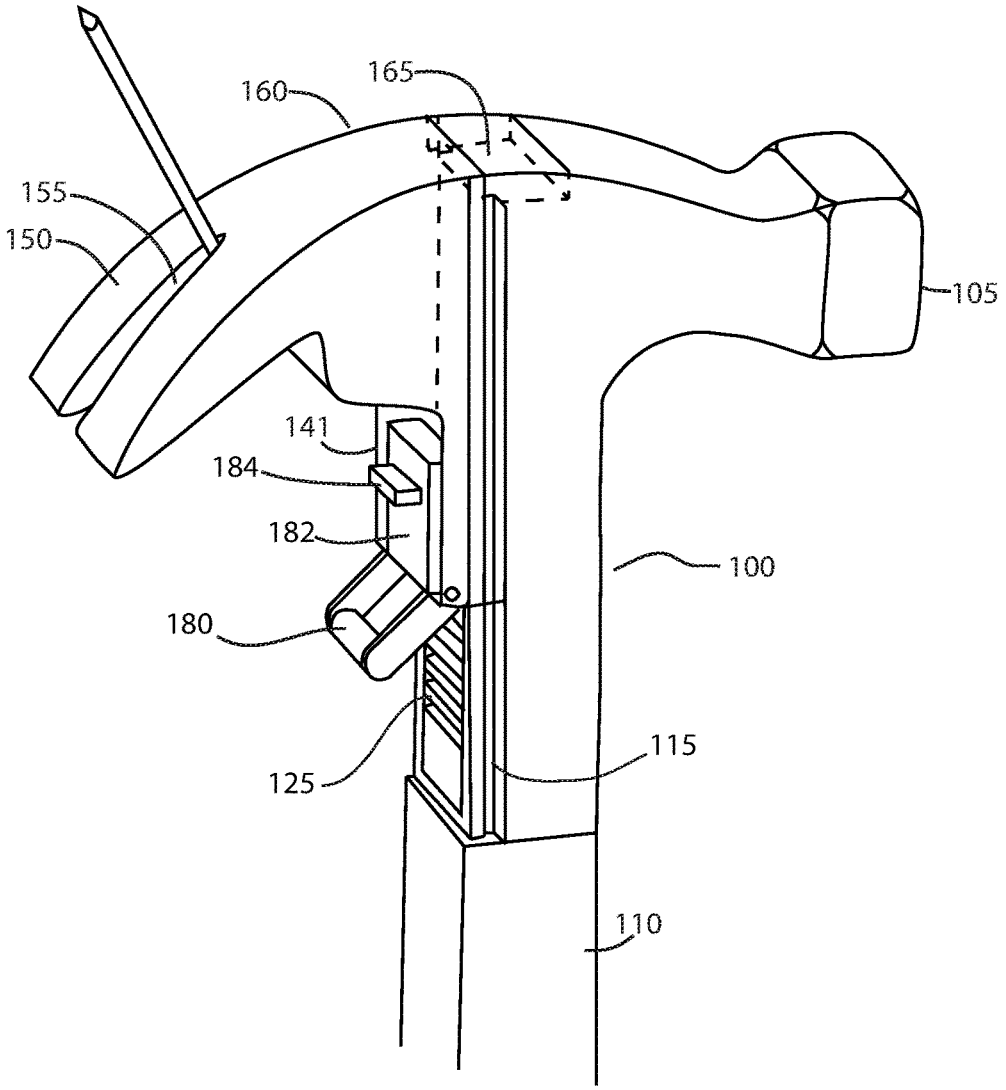
FIG. 10 provides a perspective view of another exemplary embodiment of a hammer with a linearly adjustable ratcheting claw in a retracted position according to principles of the invention.

FIG. 10 provides a perspective view of another exemplary embodiment of a hammer with a linearly adjustable ratcheting claw according to principles of the invention. The claw assembly 160 includes a claw 150 with a v-shaped groove 155 for engaging a nail 152. The claw assembly 160 is movable linearly relative to the striking head 105 of the hammer. A flanged channel is configured to engage and glide in channels 148 along an engaging portion of the handle. A ratcheting mechanism with a pivoting lever 180, a ratchet body and a ratchet switch 184 causes a pawl to engage and disengage a rack 125 of spaced apart teeth. The pawl and rack 125 regulate linear movement of the claw assembly 160. The switch 184 affects the angle of the pawl relative to the engaged teeth of the rack 125 to allow or resist movement in one direction or another. Thus, in this embodiment, movement in each direction (i.e., up/down) is controlled by ratcheting.

Alternatively, the switch 184 may have an engaged position and a free position. In the engaged position, the ratchet causes the claw assembly to move linearly away from the striking head 105 of the hammer. In the free position, the pawl is disengaged and the claw assembly may be slid linearly in either direction.

A nail head lever 145 is attached to the concave side of the claw 150. The lever 145 extends outwardly from the handle to a point past the vertex of the v-groove. During extraction of a nail using the claw 150, the head of the nail may bear against the lever 145. The lever 145 may be attached with a pivot pin 146 and magnetically biased to pivot to a locking position. A magnet 172 is provided to urge the lever and pawl into a locking position. Pivoting movement of the lever 145 may engage and release the pawl 173 to allow locking and retraction of the claw assembly 160.

Figure 11:
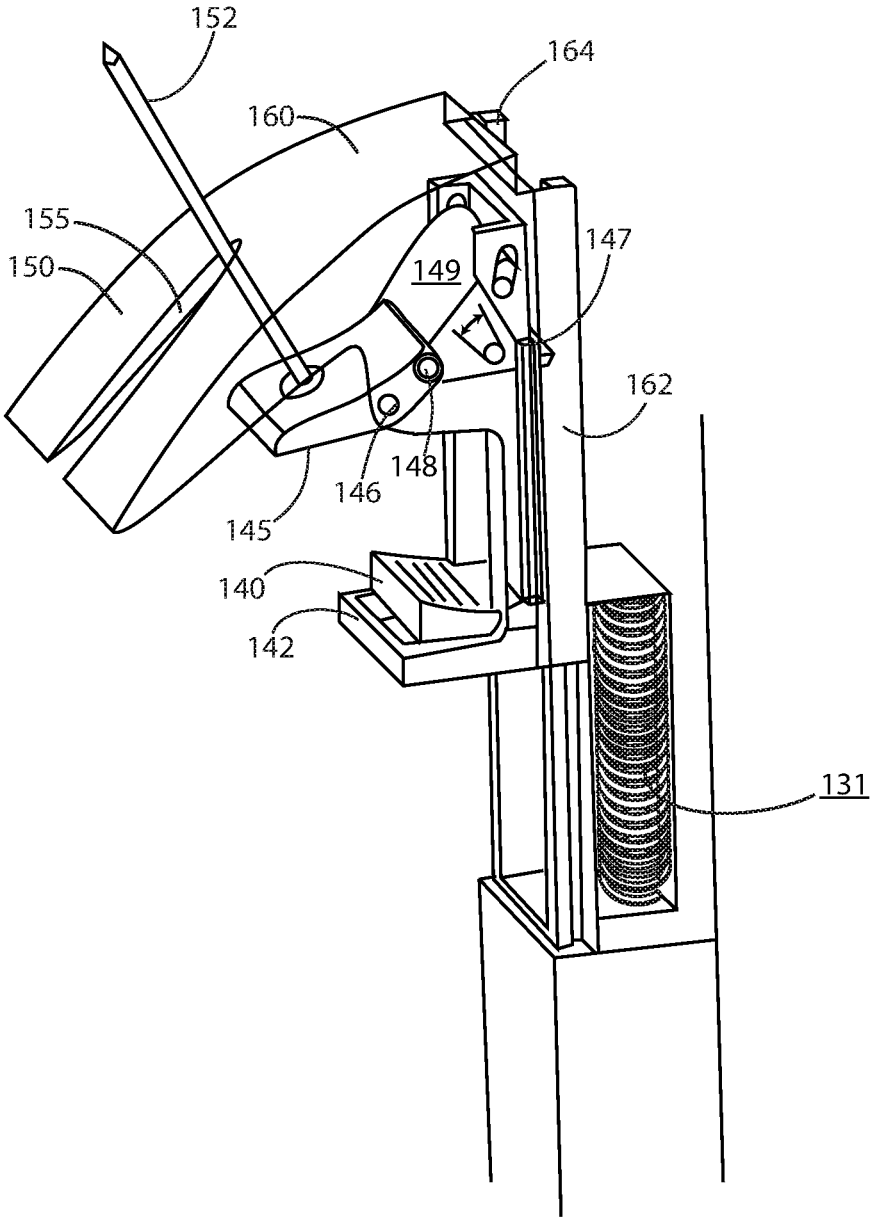
FIG. 11 provides a perspective view of an exemplary embodiment of a claw assembly for a hammer with a linearly adjustable ratcheting claw according to principles of the invention.
Figure 12:
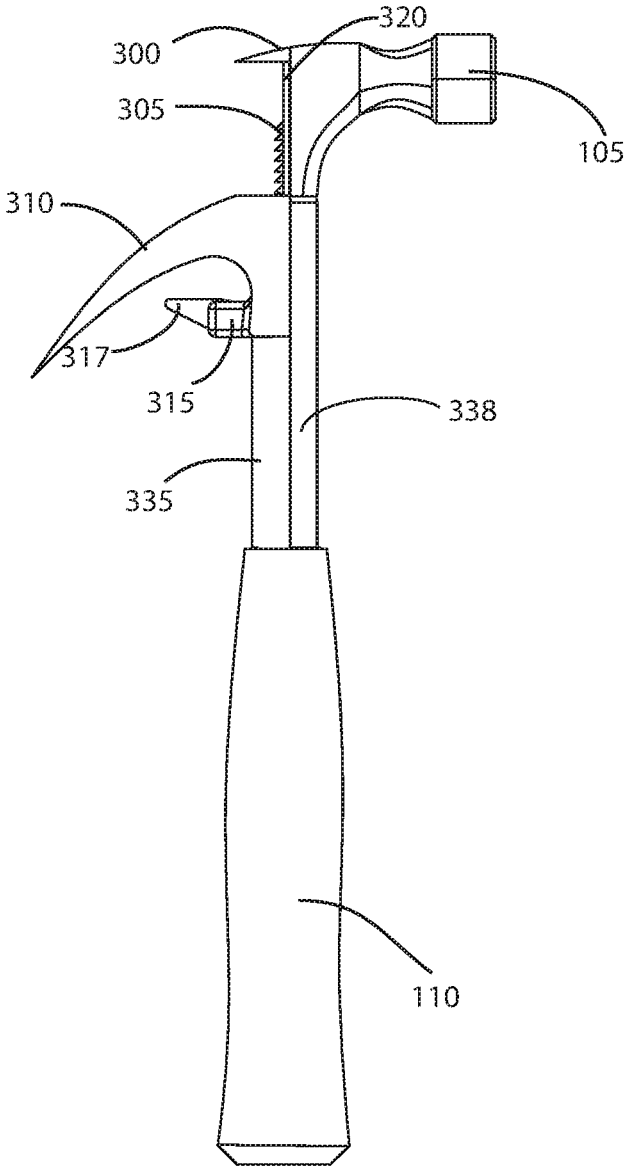
FIG. 12 provides a side view of another exemplary hammer with a linearly adjustable ratcheting claw in a lowered position according to principles of the invention.
Figure 13:
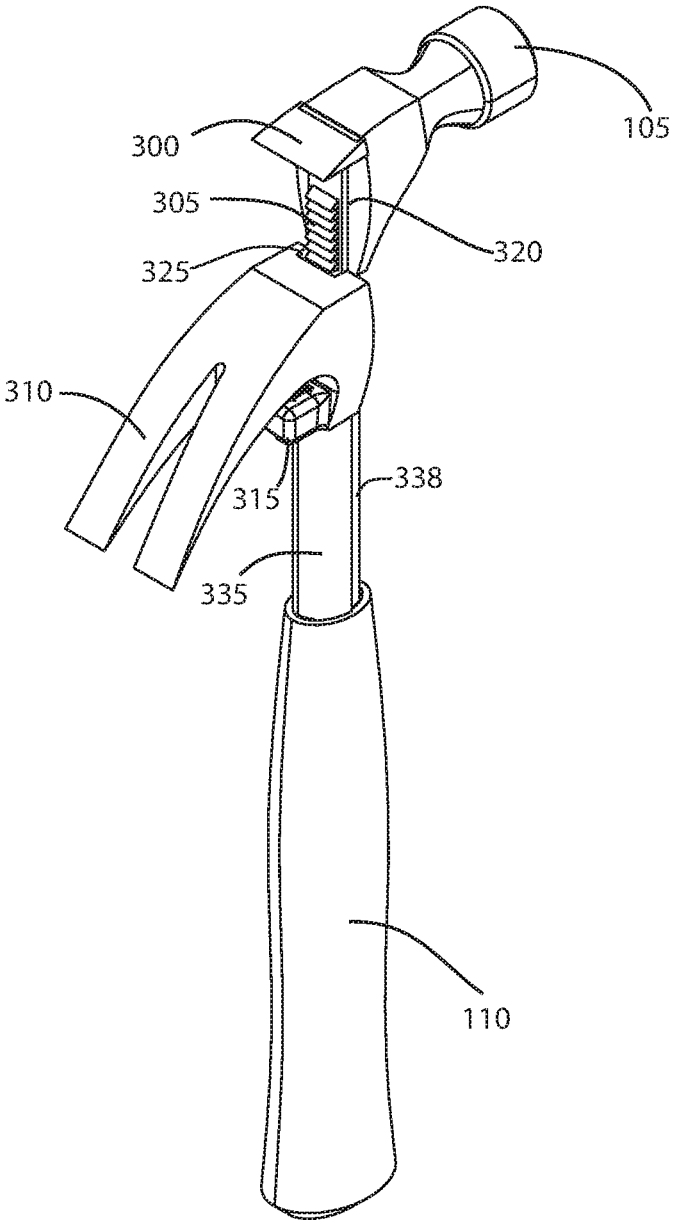
FIG. 13 provides a perspective view of an exemplary hammer with a linearly adjustable ratcheting claw in a lowered position according to principles of the invention.
Figure 14:
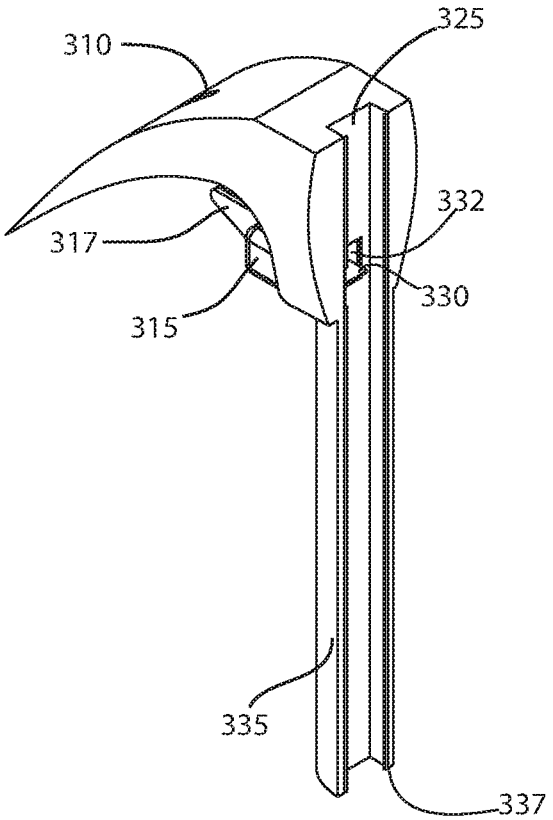
FIG. 14 provides a perspective view of an exemplary claw assembly for a hammer with a linearly adjustable ratcheting claw in a lowered position according to principles of the invention.
Figure 15:
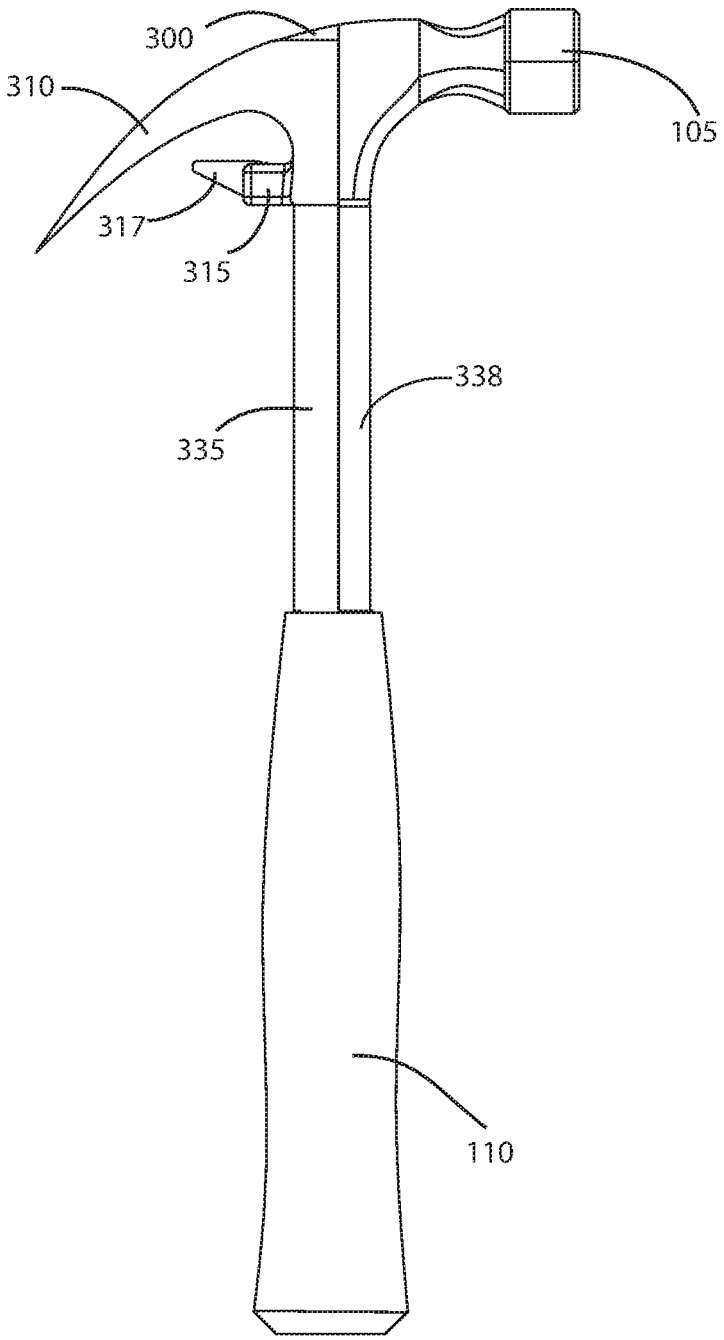
FIG. 15 provides a side view of an exemplary hammer with a linearly adjustable ratcheting claw in a raised position according to principles of the invention.
Figure 16:
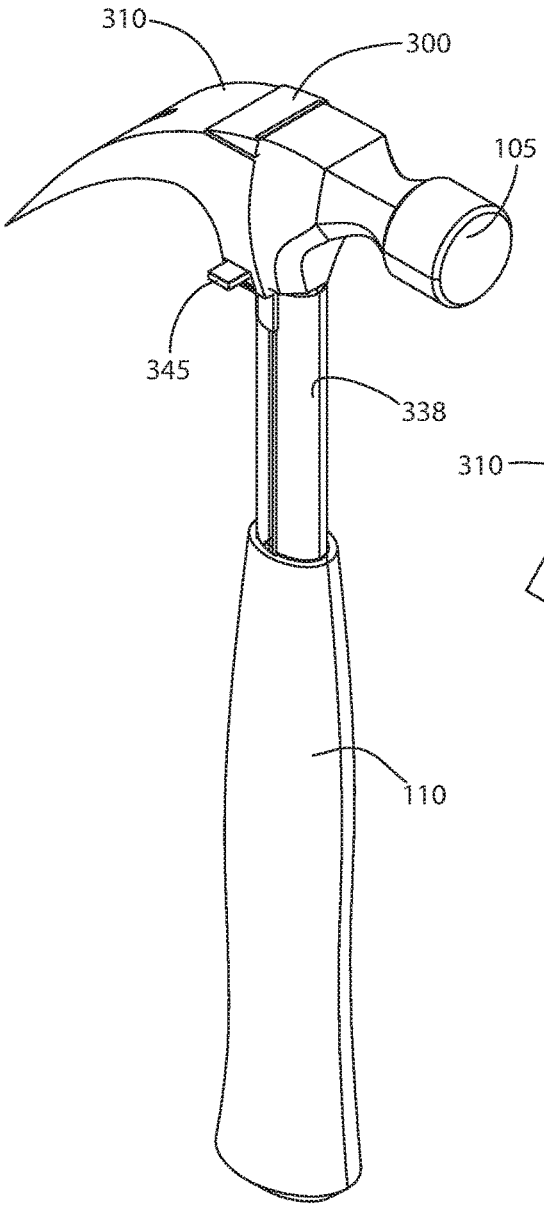
FIG. 16 provides a perspective view of an exemplary hammer with a linearly adjustable clamping claw in a raised position according to principles of the invention.
Figure 17:
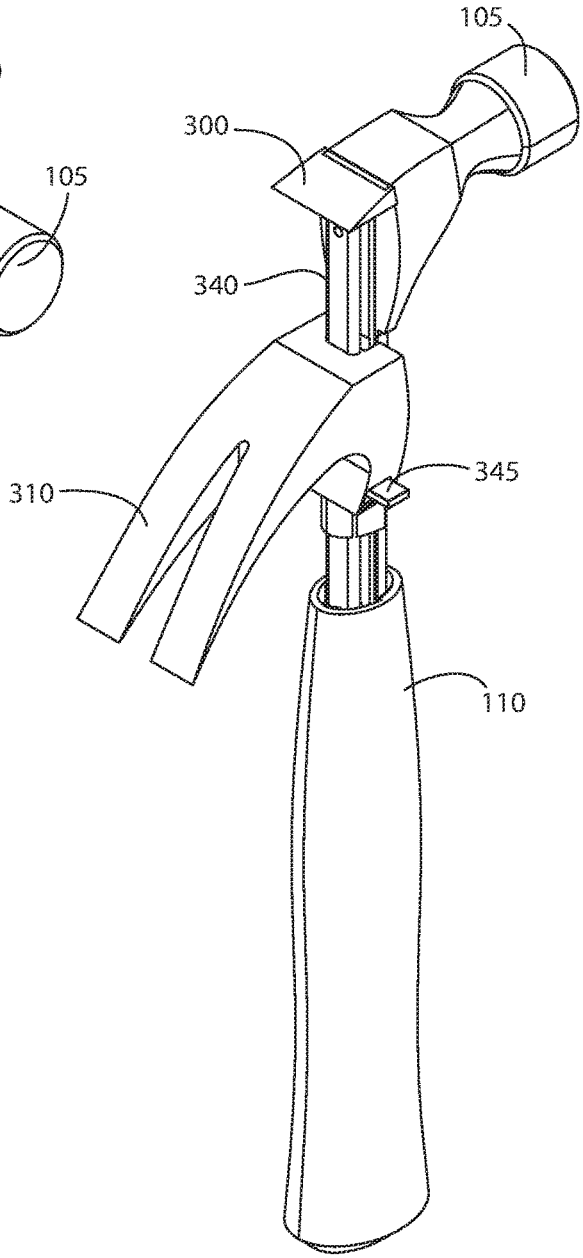
FIG. 17 provides a perspective view of an exemplary hammer with a linearly adjustable clamping claw in a lowered position according to principles of the invention.
Figure 18:
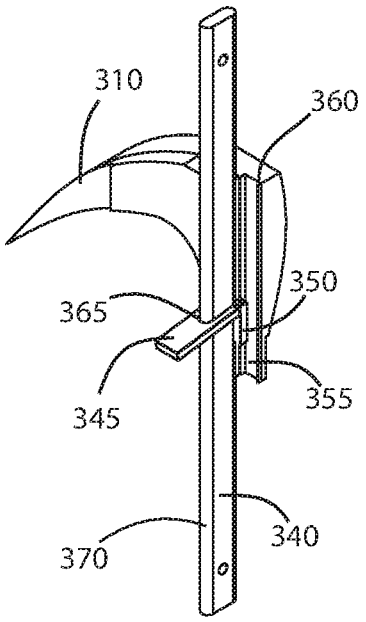
FIG. 18 provides a perspective view of an exemplary clamping mechanism for a hammer with a linearly adjustable clamping claw according to principles of the invention.
Figure 19:
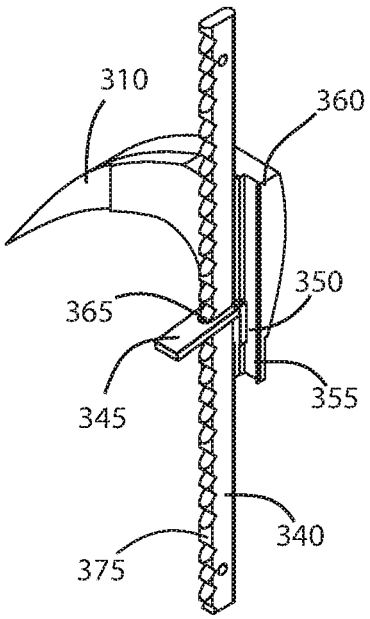
FIG. 19 provides a perspective view of another exemplary clamping mechanism for a hammer with a linearly adjustable clamping claw according to principles of the invention.

FIG. 11 provides a perspective view of an exemplary embodiment of a claw assembly 160 for a hammer with a linearly adjustable ratcheting claw according to principles of the invention. The claw assembly 160 includes a claw 150 with a v-shaped groove 155 for engaging a nail 152. The claw assembly 160 is movable linearly relative to the striking head 105 of the hammer. Flanged channels 162, 164 are configured to engage and glide in channels along an engaging portion of a handle. A ratcheting mechanism which includes a manual switch 140 that causes a pawl 147 to engage and disengage a rack of spaced apart teeth. The pawl 147 and rack regulate linear movement of the claw assembly 160.

A nail head lever 145 is attached to the concave side of the claw 150. The lever 145 extends outwardly from the handle to a point past the vertex of the v-groove. During extraction of a nail using the claw 150, the head of the nail may bear against the lever 145. The lever 145 may be attached with a pivot pin 146 and biased to pivot towards an abutting nail head. The lever 145 may also be operably pivotally coupled to a second lever 149 configured to pivot in a direction opposite to the pivoting direction of the primary lever 145. The secondary lever 149 may be spring biased, such as with a torsion spring. Pivoting movement of the primary lever 145 may engage and release the pawl to allow locking and retraction of the claw assembly 160.

A spring compartment 130 in the handle 110 contains a compression spring 131 that urges the claw assembly towards its topmost position, as discussed above in relation to FIG. 2. The spring may be a coil, leaf or other type of biasing means that resists compression.

FIGS. 12 through 15 conceptually illustrate another exemplary embodiment of a hammer with a linearly adjustable ratcheting claw. The hammer includes a handle 110 and stationary hammer head 105. A cap 300 provides a pivot point for removing a nail with the claw assembly 310. A biased pivoting pawl 330, projects through an aperture 332 [FIG. 14] to engage a toothed rack 305. A channel 325 in the claw assembly 310 provides a conduit for linear sliding motion relative to the rack 305 with a portion of the rack 305 being disposed in the channel 325. Flanges 337 which grip tracks 320 prevent separation of the claw assembly from the hammer head 105, while permitting linear motion. A lever 317 and pawl pivot point 315 allow manually control of the pawl. When the lever is pressed the tip of the pawl 330 is urged away from the rack 305. When the lever is released, the pawl engages the rack 305. The channel body 335 recedes into a cavity in the handle 110 as the claw is lowered, providing additional stability for the claw assembly 310. The hammer head is supported by a stationary arm 338.

FIGS. 16 through 19 illustrate another exemplary embodiment. Instead of a ratcheting mechanism for locking the claw assembly 310 in a position, a clamping mechanism is provided. The clamping mechanism includes a bushing or sleeve 345 (referred to herein as a sleeve) with an aperture 365 through which a bar 340 extends. When released, the sleeve 345 is biased into a skewed position relative to the bar 340, frictionally engaging the bar 340. When pressed manually, the sleeve is urged into alignment with the bar 340, allowing sliding motion of the sleeve 345 with the claw assembly 310. The bar 340 remains stationary. In the exemplary embodiment, the sleeve 345 is an L-shaped, U-Shaped or V-shaped leaf spring, with a portion attached 350 to the interior 355 of the claw assembly 310. The attached portion biases the portion with the aperture 365 into a skewed clamping alignment relative to the bar 340. The portion with the aperture 365 may be urged into alignment relative to the bar 340 to allow free sliding motion of the claw assembly 310 relative to the hammer head 105. When the portion with the aperture 365 is released, the biasing deflects the aperture 365 back into a skewed clamping alignment relative to the bar 340. An edge 370 of the bar may be smooth, textured to enhance frictional engagement with the sleeve 345, or toothed 375 to define specific engagement points between teeth. A flanged channel 350 is provided to guide linear motion of the claw assembly relative to the hammer head 105.

Figure 20:
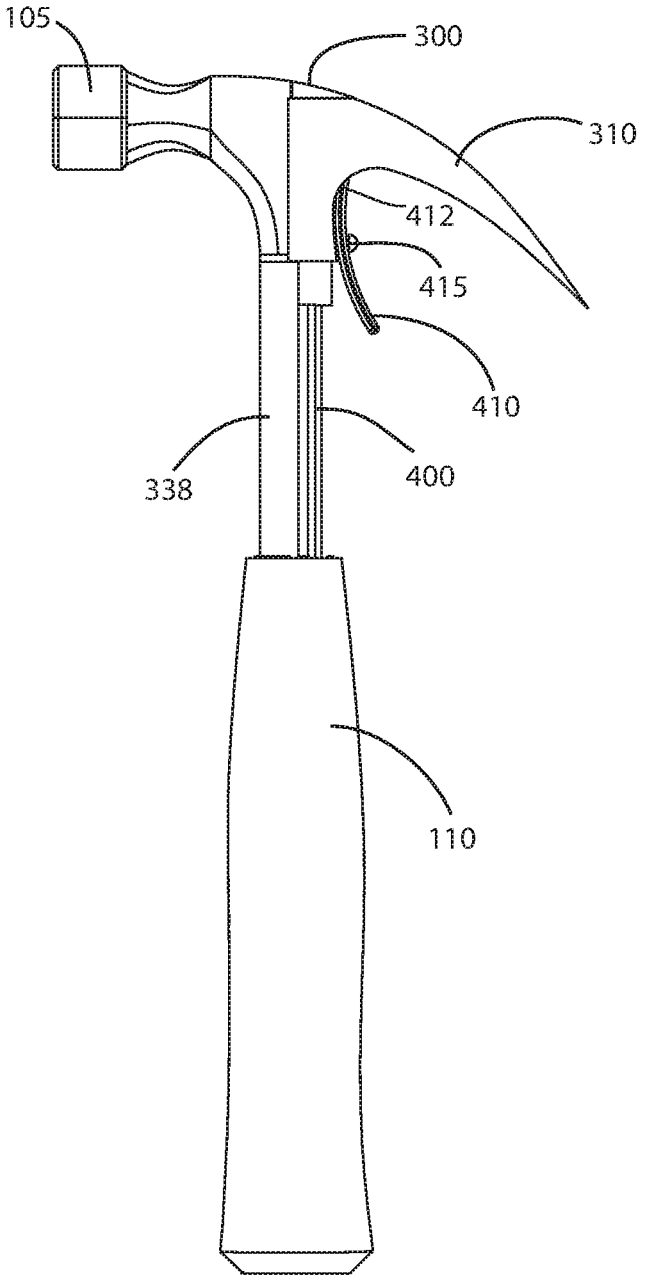
FIG. 20 provides a side view of an exemplary hammer with a linearly adjustable pin-locking claw in a raised position according to principles of the invention.
Figure 21:
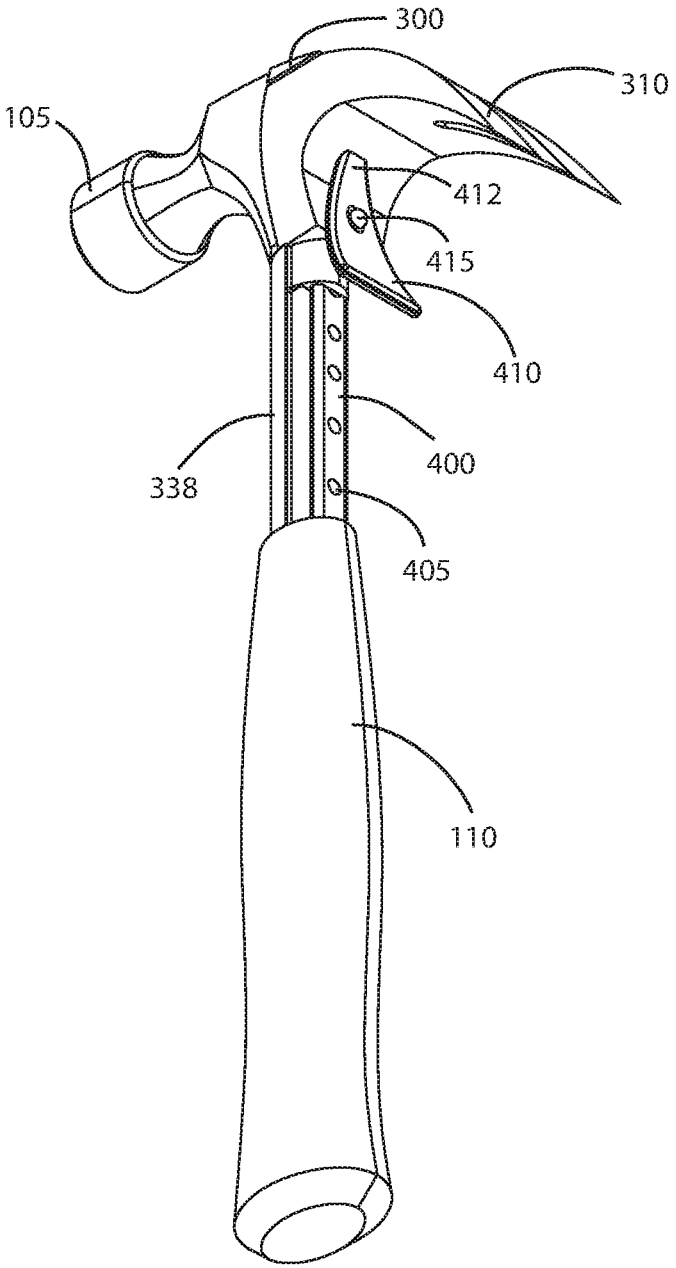
FIG. 21 provides a perspective view of an exemplary hammer with a linearly adjustable pin-locking claw in a raised position according to principles of the invention.
Figure 22:
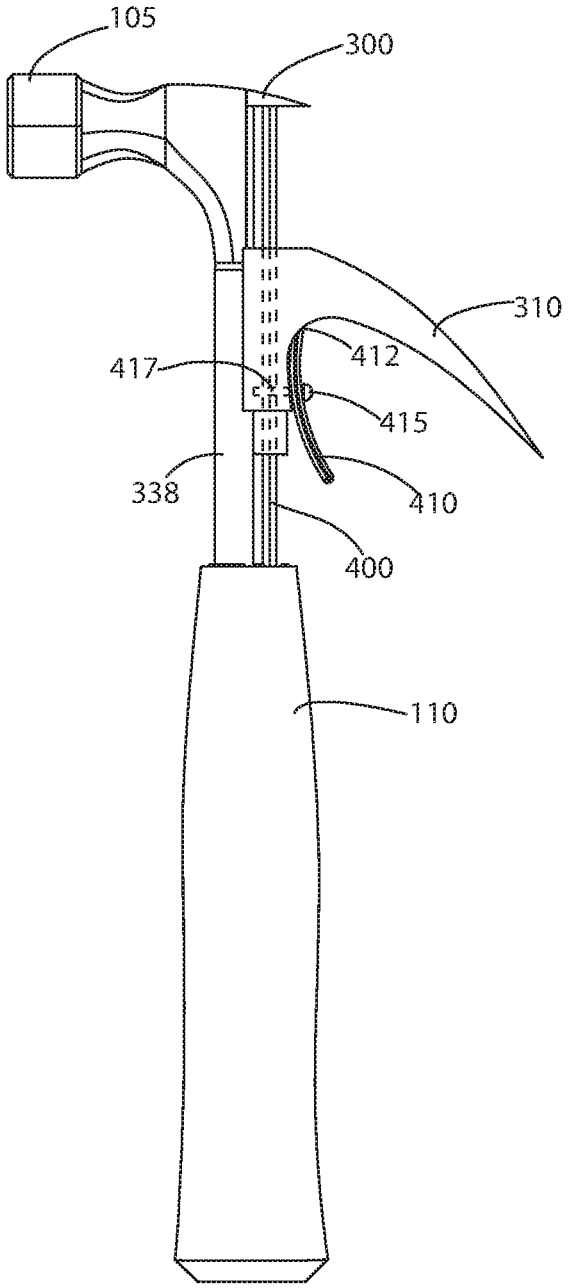
FIG. 22 provides a side view of an exemplary hammer with a linearly adjustable pin-locking claw in a lowered position according to principles of the invention.
Figure 23:
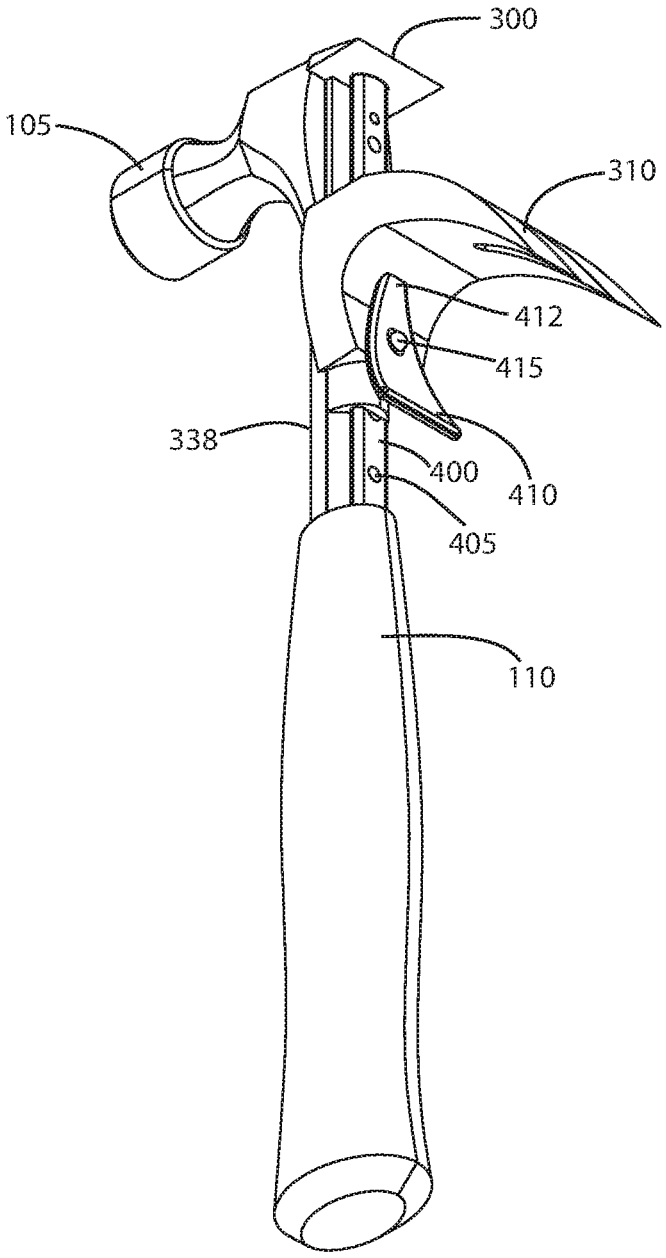
FIG. 23 provides a perspective view of an exemplary hammer with a linearly adjustable pin-locking claw in a lowered position according to principles of the invention.

FIGS. 20 through 22 conceptually illustrate an exemplary hammer with a linearly adjustable pin-locking claw according to principles of the invention. A pin with a head 415 and shaft 417 is biased towards a bar 400 with a plurality of spaced apart apertures 405. A portion of the shaft 417 extends through or into an aperture 405 when the pin is aligned with aperture 405 and released. In the exemplary embodiment, a leaf spring 410 attached at one end 412 to the claw assembly provides the biasing. The head 415 of the pin is moved away from the bar 400 by deflecting the leaf spring 410 accordingly. Movement of the head 415 away from the bar causes the pin to move out of the aperture 405. Such movement permits free sliding motion of the claw assembly 310 relative to the hammer head 105.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A hammer with a linearly moveable claw assembly, said hammer including a handle, a neck, a hammer head and a claw assembly, wherein:

the neck of the hammer having a first end and an opposite second end, the handle being attached to the first end and the hammer head being attached to the second end;

the claw assembly including a claw body from which a curved two-prong claw extends, the claw body containing a guide and locking mechanism, the guide including a bar parallel to the neck and attached to the neck extending between the hammer head and handle, the locking mechanism comprising a bar clamp within the claw body, said bar clamp including a sleeve having an aperture through which the bar extends and a leaf spring that protrudes laterally, externally from the claw assembly, the bar clamp being moveable from a released position to an engaged position, in the released position the bar clamp disengaging the bar, and in the engaged position said bar clamp frictionally engaging the bar and resisting movement of the bar clamp relative to the bar, the guide slidingly engaging the neck, and the locking mechanism controllably securing the claw assembly at a position along the neck, the claw assembly having a flanged channel for guiding linear motion of the claw assembly relative to the hammer head; and the claw assembly being linearly moveable between the first end and second end of the neck.

2. The hammer with a linearly moveable claw assembly according to claim 1, the leaf spring and bar clamp being integrally formed.

3. The hammer with a linearly moveable claw assembly according to claim 1, the bar clamp including an end extending from the claw body, said end being manipulable by a user to move the bar clamp from an engaged position to a released position.

4. The hammer with a linearly moveable claw assembly according to claim 1, the bar being textured to enhance frictional engagement.

5. The hammer with a linearly moveable claw assembly according to claim 1, the bar comprising a rack with a plurality of spaced apart teeth.

* * * * *